US008099968B2

(12) United States Patent
Watson et al.

(10) Patent No.: US 8,099,968 B2
(45) Date of Patent: Jan. 24, 2012

(54) METHOD AND APPARATUS FOR CIRCULATING AIR WITHIN AN ICEMAKER COMPARTMENT OF A REFRIGERATOR

(75) Inventors: Eric K. Watson, Crestwood, KY (US); Omar Haidar, Louisville, KY (US); Kenneth U. Nsofor, Louisville, KY (US); Matthew William Davis, Prospect, KY (US); Ronald Scott Tarr, Louisville, KY (US); Joseph Waugh, Louisville, KY (US)

(73) Assignee: General Electric Company, Schenectady, NY (US)

( * ) Notice: Subject to any disclaimer, the term of this patent is extended or adjusted under 35 U.S.C. 154(b) by 564 days.

(21) Appl. No.: 12/361,732

(22) Filed: Jan. 29, 2009

(65) Prior Publication Data

US 2010/0186429 A1 Jul. 29, 2010

(51) Int. Cl.
*F25C 1/00* (2006.01)

(52) U.S. Cl. ..... 62/66; 62/344

(58) Field of Classification Search ..... 62/66, 344, 62/348, 351, 352, 353, 419, 449, 135, 186, 62/158

See application file for complete search history.

(56) References Cited

U.S. PATENT DOCUMENTS

| | | | | |
|---|---|---|---|---|
| 4,129,994 | A * | 12/1978 | Ku | 62/179 |
| 2004/0261433 | A1 * | 12/2004 | Gnadinger | 62/137 |
| 2004/0261434 | A1 * | 12/2004 | Zentner et al. | 62/137 |
| 2007/0119203 | A1 * | 5/2007 | Nall et al. | 62/340 |
| 2007/0186570 | A1 * | 8/2007 | Kopf | 62/135 |
| 2007/0209382 | A1 * | 9/2007 | Kim et al. | 62/340 |
| 2008/0022703 | A1 * | 1/2008 | Cook et al. | 62/135 |

* cited by examiner

*Primary Examiner* — Mohammad Ali
(74) *Attorney, Agent, or Firm* — Global Patent Operation; Douglas D. Zhang

(57) ABSTRACT

A method and apparatus for circulating air within an icemaker compartment of a refrigerator are disclosed. The method includes the steps of activating the icemaker, filling the ice cavities with water, and activating the fan after a predetermined time after the ice cavities are filled with water. The apparatus includes a food storage compartment, an access door operable to selectively close the food storage compartment, an icemaker compartment on the access door, an icemaker disposed in the icemaker compartment, the icemaker including an ice mold body defining a plurality of ice cavities, an ice storage bin disposed in the icemaker compartment, a fan for distributing cold air within the icemaker compartment, at least one heating element attached to the ice mold body, a coolant pump, and a controller for regulating the fan and the coolant pump.

29 Claims, 7 Drawing Sheets

METHOD AND APPARATUS FOR CIRCULATING AIR WITHIN AN ICEMAKER COMPARTMENT OF A REFRIGERATOR

BACKGROUND OF THE INVENTION

The present invention relates generally to refrigerators, and more specifically, to methods and apparatus for circulating air within an icemaker compartment of a refrigerator.

Generally, a refrigerator includes a sealed refrigerating/cooling circuit or system comprising an evaporator, a compressor, a condenser and an expansion device. Typically the evaporator is located in the freezer compartment of the refrigerator to provide a source of cold air which is then distributed to other areas or compartments of the refrigerator to provide cooling as needed.

It is now common in the art of refrigerators to provide an automatic icemaker. In a "side-by-side" type refrigerator where the freezer compartment is arranged to the side of the fresh food compartment, the icemaker is usually disposed in the freezer compartment and delivers ice through an opening in the access door of the freezer compartment. In this arrangement, ice is formed by freezing water with cold air in the freezer compartment, the air being made cold by the cooling circuit or system of the refrigerator. In a "bottom freezer" type refrigerator where the freezer compartment is arranged below a top fresh food compartment, convenience necessitates that the icemaker be disposed in the access door of the top mounted fresh food compartment and deliver ice through an opening in the access door of the fresh food compartment, rather than through the access door of the freezer compartment. It is known in the art that a way to form ice in this configuration is to deliver cold air, which is cooled by the evaporator of the cooling system, through appropriate air ducts to the interior cavity of an icemaker compartment on the access door of the fresh food compartment that houses the icemaker to maintain the icemaker at a temperature below the freezing point of water.

It is known to include a fan to distribute an air current to such an icemaker compartment. Typically this fan is in the freezer compartment, and requires an air duct to transport the air into the icemaker compartment from the freezer compartment. Usually this fan operates regardless of the stage in the ice making process, the temperature within the icemaker compartment, or operational status of the compressor.

The ductwork typically used to distribute air from the fan is an inefficient way to create an air current within the icemaker compartment. The angles and the length of the air duct reduce the pressure and flow of air coming from the fan. This inefficiency creates an icemaker compartment with an uneven temperature distribution because of a lack of proper air current to all parts of the icemaker compartment. This uneven temperature distribution makes forming ice less efficient and less accurate because some cubes in one area of an ice mold body may be warmer and not freeze fully, or may be too cold and over freeze.

Therefore, an ability to operate more efficiently, both in speed of ice production and in operation of the components within the icemaker compartment is desired. Therefore, it would be desirable to provide a method and apparatus for making air circulation within an icemaker compartment of a refrigerator more efficient.

BRIEF DESCRIPTION OF THE INVENTION

As described herein, the exemplary embodiments of the present invention overcome one or more of the above or other disadvantages known in the art.

One aspect of the present invention relates to a method of circulating air within an icemaker compartment of a refrigerator. The icemaker compartment includes a fan, a heater, and an icemaker having an ice mold body defining a plurality of ice cavities, and the refrigerator includes a water valve for controlling water flow to the icemaker and a coolant pump for controlling the delivery of coolant to the icemaker compartment. The method includes the steps of activating the icemaker, filling the ice cavities with water, activating the coolant pump, and activating the fan after a predetermined time after the ice cavities are filled with water.

Another aspect of the present invention relates to a method of circulating air within an icemaker compartment of a refrigerator. The icemaker compartment includes a fan, a heater, and an icemaker having an ice mold body defining a plurality of ice cavities, and the refrigerator includes a water valve for controlling water flow to the icemaker and a coolant pump for controlling the delivery of coolant to the icemaker compartment. The method includes the steps of activating the coolant pump, activating the fan in response to activation of the coolant pump, deactivating the coolant pump, and deactivating the fan in response to deactivation of the coolant pump.

Another aspect of the present invention relates to a refrigerator. The refrigerator includes a food storage compartment, an access door operable to selectively close the food storage compartment, an icemaker compartment on the access door, an icemaker disposed in the icemaker compartment and including an ice mold body defining a plurality of ice cavities, an ice storage bin, a fan for distributing cold air within the icemaker compartment, at least one heating element attached to the ice mold body, a coolant pump, and a controller for regulating the fan and the coolant pump.

Yet another aspect of the present invention relates to a method of circulating air within an icemaker compartment of a refrigerator. The icemaker compartment includes a fan, an icemaker and an ice storage bin. The refrigerator includes a coolant pump for controlling the delivery of coolant to the icemaker compartment. The method includes the steps of deactivating the icemaker by deactivating the coolant pump, activating the fan after the icemaker is deactivated, and deactivating the fan after a predetermined time period after activating the fan.

These and other aspects and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and that, unless otherwise indicated, they are merely intended to conceptually illustrate the structures and procedures described herein.

DETAILED DESCRIPTION OF THE EXEMPLARY EMBODIMENTS OF THE INVENTION

Figure 1:
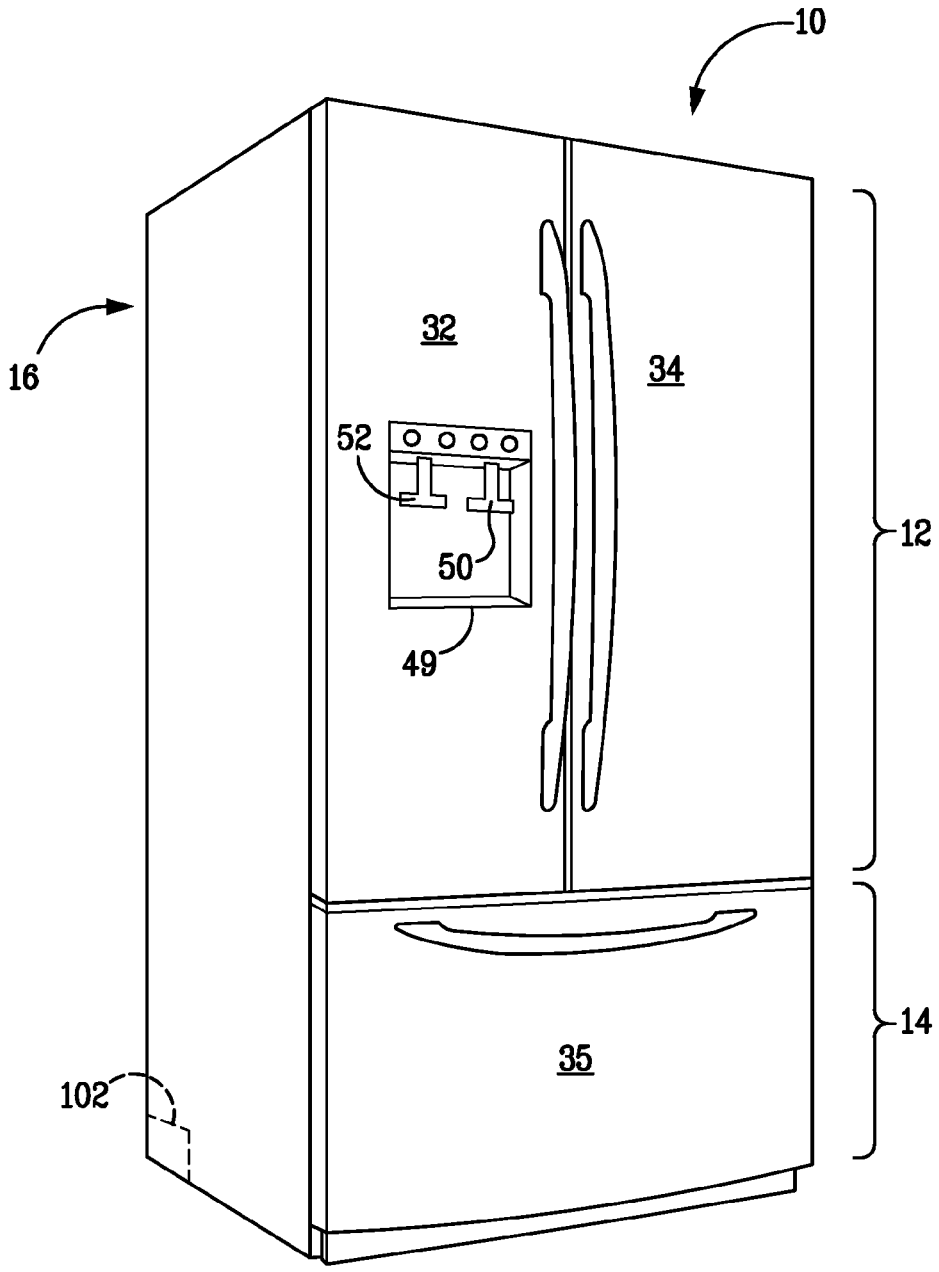
FIG. 1 is a perspective view of a refrigerator in accordance with an exemplary embodiment of the present invention.

FIG. 1 illustrates an exemplary refrigerator 10. While the embodiments are described herein in the context of a specific refrigerator 10, it is contemplated that the embodiments may be practiced in other types of refrigerators. Therefore, as the benefits of the herein described embodiments accrue generally to air circulation within the refrigerator, the description herein is for exemplary purposes only and is not intended to limit practice of the invention to a particular refrigeration appliance or machine, such as refrigerator 10.

On the exterior of the refrigerator 10, there is an external recessed access area 49 for dispensing of drinking water and ice cubes. Upon a stimulus, a water dispenser 50 allows an outflow of drinking water into a user's receptacle (not shown). Upon another stimulus, an ice dispenser 52 allows an outflow of ice cubes into a user's receptacle. There are two access doors 32 and 34 to the fresh food compartment 12, and one access door 35 to the freezer compartment 14. Refrigerator 10 is contained within an outer case 16.

Figure 2:
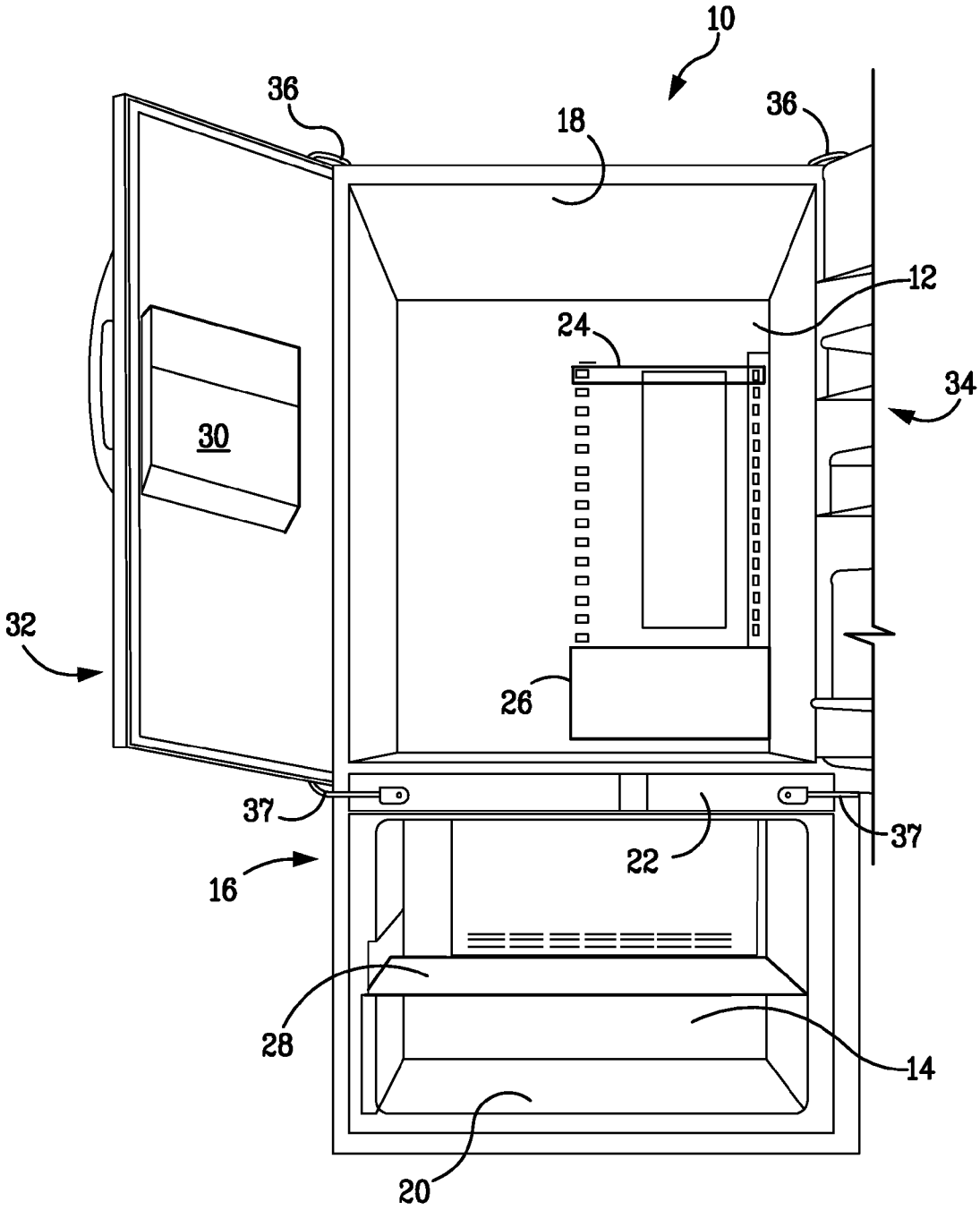
FIG. 2 is a perspective view of the refrigerator of FIG. 1 with the refrigerator doors being in an open position and the freezer door being removed for clarity.

FIG. 2 illustrates the refrigerator 10 with its upper access doors 32, 34 in the open position. Refrigerator 10 includes food storage compartments such as fresh food compartment 12 and freezer compartment 14. As shown, fresh food compartment 12 is located above freezer compartment 14 in a bottom mount refrigerator-freezer configuration. Refrigerator 10 includes outer case 16 and inner liners 18 and 20 for compartments 12 and 14, respectively. A space between outer case 16 and liners 18 and 20, and between liners 18 and 20, is filled with foamed-in-place insulation. Outer case 16 normally is formed by folding a sheet of a suitable material, such as pre-painted steel, into an inverted U-shape to form top and side walls of the case. A bottom wall of outer case 16 normally is formed separately and attached to the case side walls and to a bottom frame that provides support for refrigerator 10. Inner liners 18 and 20 are molded from a suitable plastic material to form fresh food compartment 12 and freezer compartment 14, respectively. Alternatively, liners 18, 20 may be formed by bending and welding a sheet of a suitable metal, such as steel. The illustrative embodiment includes two separate liners 18, 20 as it is a relatively large capacity unit and separate liners add strength and are easier to maintain within manufacturing tolerances.

The insulation in the space between the bottom wall of liner 18 and the top wall of the liner 20 is covered by another strip of suitable resilient material, which also commonly is referred to as a mullion 22. Mullion 22 in one embodiment is formed of an extruded ABS material.

Shelf 24 and slide-out drawer 26 can be provided in fresh food compartment 12 to support items being stored therein. A combination of shelves, such as shelf 28, is provided in freezer compartment 14.

Left side fresh food compartment door 32, right side fresh food compartment door 34, and a freezer door 35 close access openings to fresh food compartment 12 and freezer compartment 14, respectively. In one embodiment, each of the doors 32, 34 are mounted by a top hinge assembly 36 and a bottom hinge assembly 37 to rotate about its outer vertical edge between a closed position, as shown in FIG. 1, and an open position, as shown in FIG. 2. An icemaker compartment 30 can be seen on the interior of left side fresh food compartment door 32.

Figure 3:
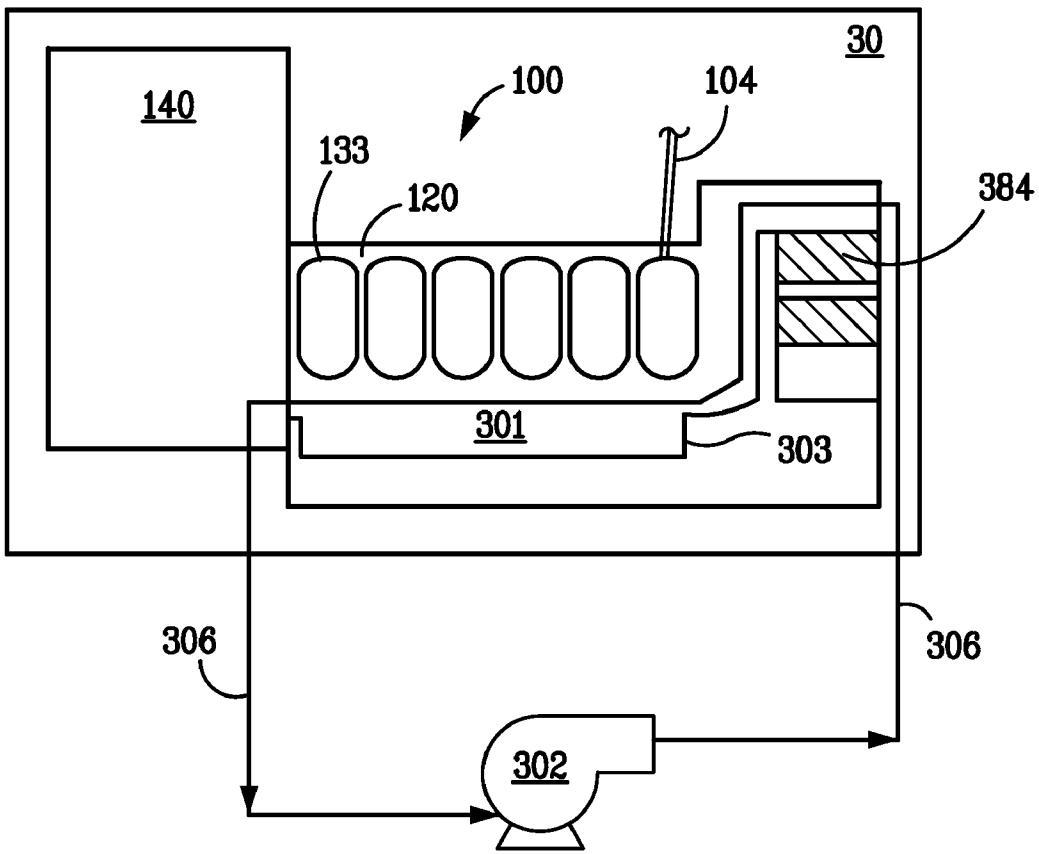
FIG. 3 is a schematic illustration of a refrigeration compartment including an icemaker.

FIG. 3 schematically shows exemplary icemaker compartment 30 with an icemaker 100 having an ice mold body 120 and a control housing 140, and a fan 384 disposed therein and preferably attached to icemaker 100. A water inlet 104 is attached to a water valve 102 (which is shown in FIG. 1) and icemaker 100, allowing water to pass from water valve 102 to ice cavities 133 in the ice mold body 120.

A coolant pump 302, located within the refrigerator but outside the icemaker compartment 30, distributes coolant to icemaker compartment 30 through a circulation loop 306, cooling icemaker compartment 30 by passing coolant through heat exchanger 303 to maintain the temperature of the icemaker compartment below about −9° C. Coolant also passes through channel 301 in ice mold body 120 so that water in ice cavities 133 of the ice mold body 120 forms ice cubes. In one illustrative embodiment the coolant is a mixture of water and glycol. Such cooling configuration for the icemaker compartment 30 is discussed in greater detail in commonly owned application Ser. No. 11/958,900, filed Dec. 18, 2007, the entire content of which is incorporated herein by reference.

Figure 4:
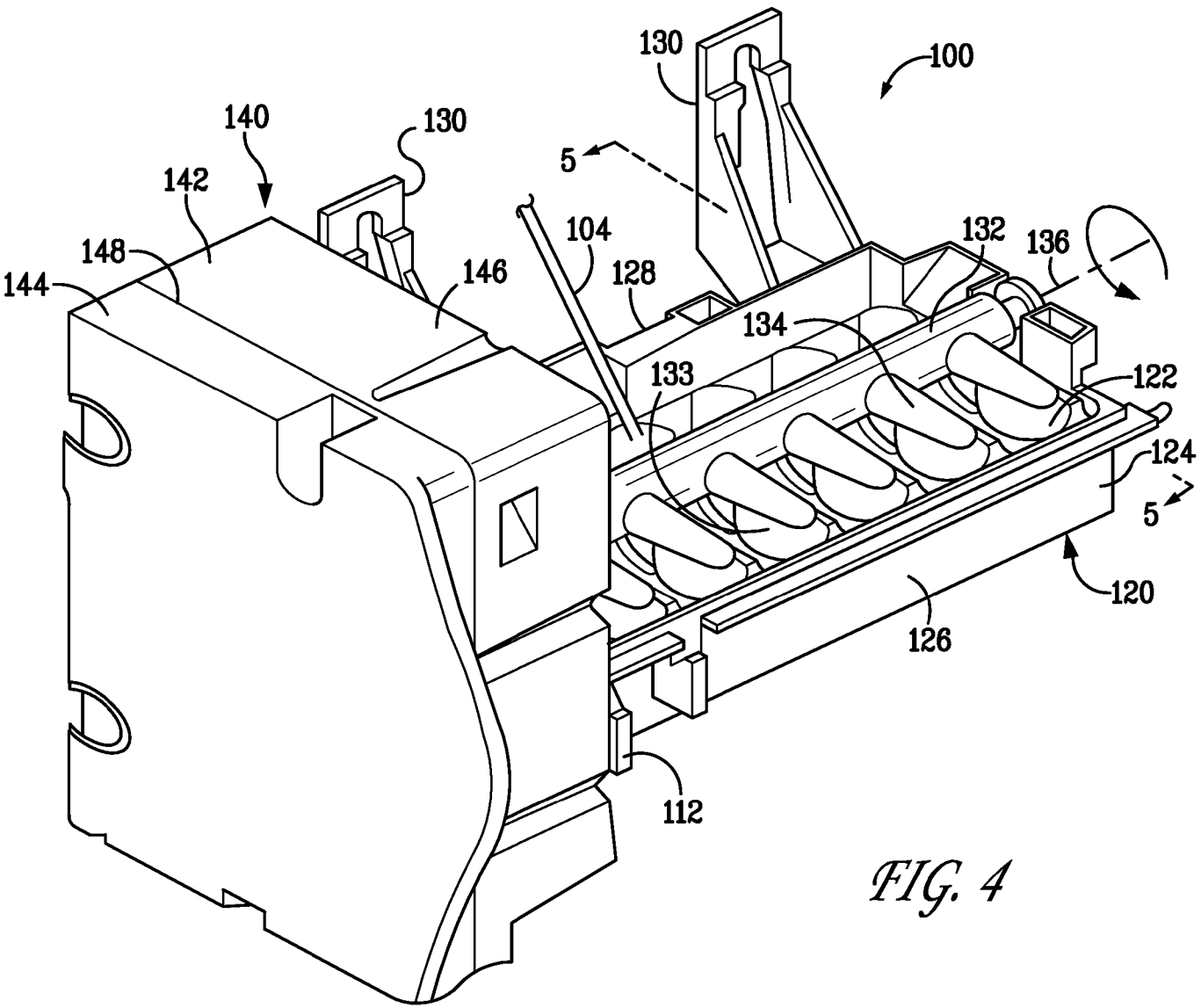
FIG. 4 is a perspective view of the icemaker of FIG. 1.

FIG. 4 is a perspective view of icemaker 100 including ice mold body 120 and a control housing 140. Ice mold body 120 includes an open top 122 extending between a mounting end 112 and a free end 124 of ice mold body 120. Ice mold body 120 also includes a front face 126 and a rear face 128. Front face 126 is substantially aligned with ice storage bin 240 (shown in FIG. 5) when icemaker 100 is mounted within icemaker compartment 30 such that ice cubes or pieces 242 are dispensed from ice mold body 120 at front face 126 into ice storage bin 240. Referring back to FIG. 4, in one embodiment, mounting brackets 130 extend upward from rear face 128. Water valve 102 is operatively connected to controller 305 (FIG. 6) for controlling flow of water to the ice cavities 133 of ice mold body 120 through water inlet 104.

Icemaker 100 includes rake 132 which extends from control housing 140 along open top 122. Rake 132 includes individual fingers 134 receivable within the respective ice cavities 133 of ice mold body 120. In operation, rake 132 is rotated about an axis of rotation or rake axis 136 that extends generally parallel to front face 126 or rear face 128. A motor (not shown) is housed within control housing 140 and is used for turning or rotating rake 132 about axis of rotation 136.

In one exemplary embodiment, control housing 140 is provided at mounting end 112 of ice mold body 120. Control housing 140 includes a housing body 142 and an end cover 144 attached to housing body 142. Housing body 142 extends between a first end 146 and a second end 148. First end 146 is secured to mounting end 112 of ice mold body 120. Alternatively, housing body 142 and ice mold body 120 are integrally formed. The end cover 144 is coupled to second end 148 of housing body 142 and closes access to housing body 142. In an alternative embodiment, end cover 144 is integrally formed with housing body 142. Housing body 142 houses a motor and/or the controller 305.

Figure 5:
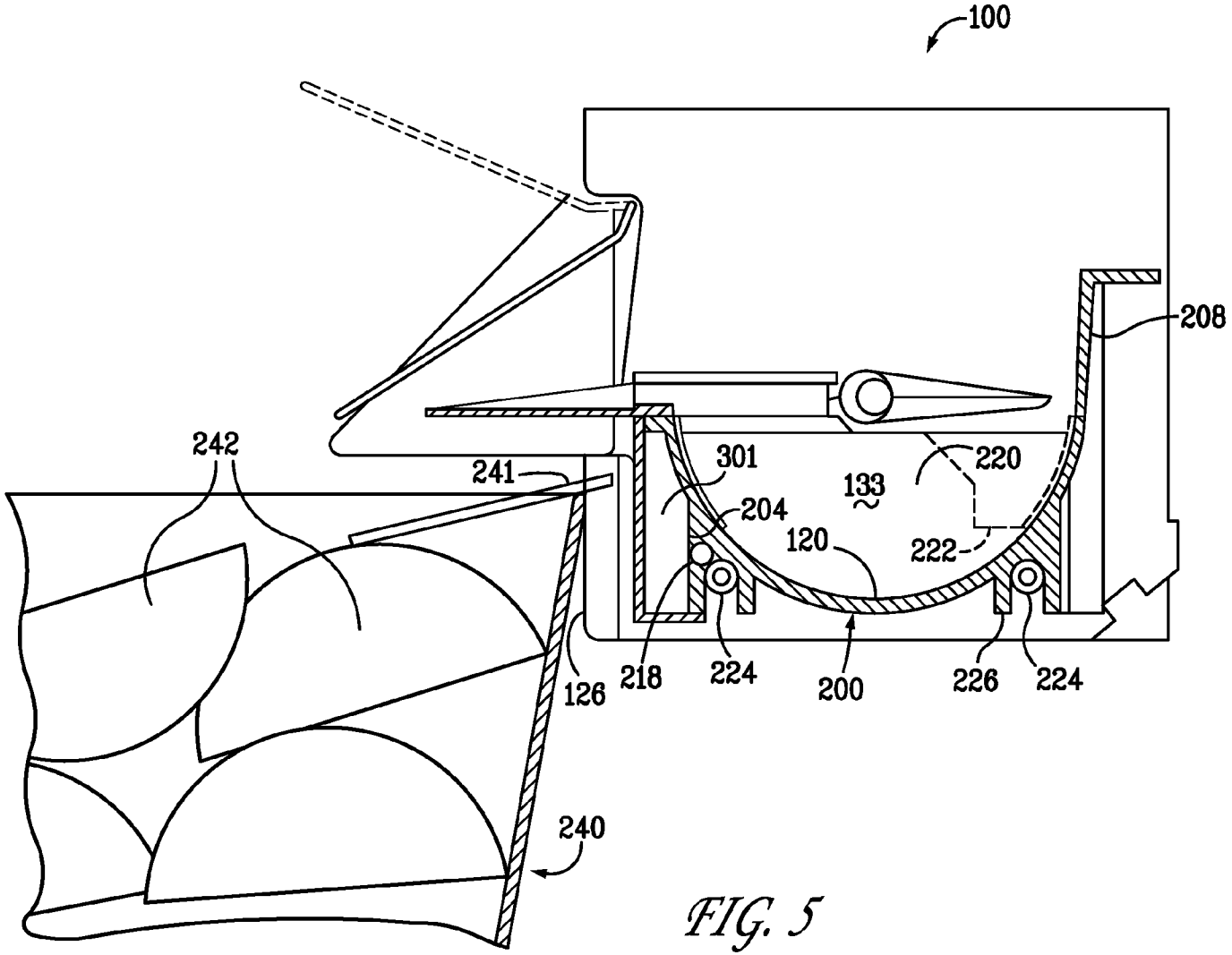
FIG. 5 is a cross sectional view of the icemaker of FIG. 4 along lines 5-5 of FIG. 4 together with an ice storage bin.

FIG. 5 is a cross sectional view of icemaker 100 taken along lines 5-5 of FIG. 4. As shown in FIG. 5, ice mold body 120 includes a bottom wall 200, a front wall 204, and a rear wall 208. Preferably, a temperature sensor such as a thermistor 218 is adjacent to and in thermal connection with ice mold body 120 and in this embodiment is shown to be connected to front wall 204. The temperature sensor 218 is in communication with controller 305 for determination of temperature values during the ice making process.

A plurality of partition walls 220 extend transversely across ice mold body 120 to define the plurality of ice cavities 133 in which ice cubes 242 can be formed. Each partition wall 220 includes a recessed upper edge portion 222. As water is added to one of the ice cavities 133, the individual ice cavity 133 volume is filled until the water flows into the adjacent ice cavity 133 through recessed upper edge portion 222. This continues until all ice cavities 133 have been filled.

In one embodiment, heaters such as two sheathed electrical resistance heating elements 224 are attached, such as by press-fitting, staking, and/or clamping into a bottom support structure 226 of ice mold body 120. In another embodiment, there is only one heating element 224. The heating elements 224 heat ice mold body 120 when an ice harvest cycle begins in order to slightly melt ice cubes 242 to allow the ice cubes 242 to be released from ice cavities 133. Rotating rake 132 sweeps through ice cavities 133 of ice mold body 120 as ice cubes are harvested and ejects the ice cubes from ice mold body 120 into ice storage bin 240.

A sensor arm 241 evaluates the amount of ice within ice storage bin 240, and signals controller 305 to begin the ice making process to form more ice cubes, or stop the ice making process because enough ice is within the ice storage bin 240.

Figure 6:
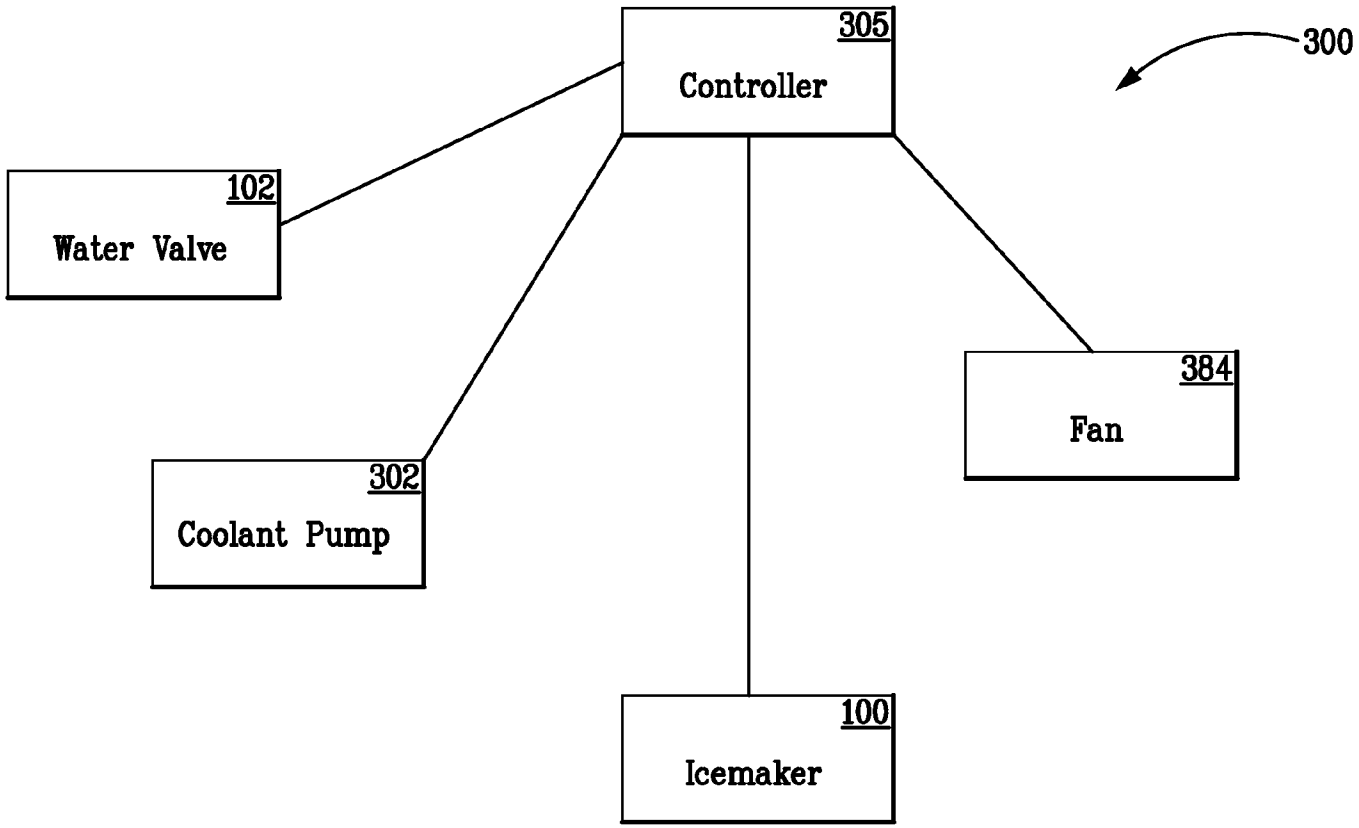
FIG. 6 is a block diagram of an exemplary control system.

FIG. 6 is a block diagram of an exemplary control system 300. Control system 300 includes controller 305, which is in communication with icemaker 100, fan 384, water valve 102 and coolant pump 302. Controller 305 controls the operation of the rake 132 and heating elements 224 of icemaker 100 during the ice harvest cycle. Controller 305 controls the operation of water valve 102 during the ice making cycle. Controller 305 also controls the operation of coolant pump 302 during the ice making cycle.

Fan 384 is included within the icemaker compartment 30 to better control the production and storage of ice. In one exemplary embodiment, fan 384 is turned on in response to coolant pump 302 being turned on, and fan 384 is turned off in response to coolant pump 302 being turned off, with this overall cycle repeating. Fan 384 can be turned on after a short delay period in response to coolant pump 302 being turned on, and turned off after a short delay period in response to coolant pump 302 being turned off. Preferably, fan 384 is turned on only after fresh coolant reaches the ice mold body 120 (in one embodiment, fan 384 is turned on about 10 seconds after the coolant pump 302 is turned on), and fan 384 is turned off only after there is little cooling capacity left in the coolant in the ice mold body 120 (in one embodiment, fan 384 is turned off about 60 seconds after the coolant pump 302 is turned off).

This fan cycle allows for a distribution of cold air from heat exchanger 303 in the icemaker compartment 30 while coolant is being pumped through the heat exchanger 303, thereby absorbing heat. By increasing distribution of cold air, this fan cycle increases the rate at which solid ice cubes are formed and reduces the amount of melting of stored ice. During ice storage, an elevated temperature may form in the ice storage bin 240. Cycling of the fan 384 will increase distribution of cold air to the ice storage bin 240 thereby decreasing elevated temperatures.

The coolant pump 302 may be cycled on and off to meet the cooling needs of the icemaker compartment 30 both for making ice and storing ice. This may be accomplished by an open loop control arrangement, based on a pre-determined timing cycle, or by a closed loop control arrangement as a function of the temperature in the icemaker compartment 30 or alternatively, the temperature of the ice mold body 120, or both. When the coolant pump 302 is controlled by the temperature in the icemaker compartment 30, the coolant pump 302 will activate when the icemaker compartment 30 reaches a first temperature, and deactivate when the icemaker compartment 30 reaches a second temperature, which is lower than the first temperature.

During the stored ice phase which is the period between ice making cycles, when the icemaker 100 is deactivated and no new ice is being made, the fan cycle is designed to both reduce sublimation of stored ice and promote an even temperature gradient throughout the icemaker compartment 30. During the stored ice phase the fan 384 operates based on a stored ice phase schedule (which can be stored in the controller 305, for example), which is independent of coolant pump operation. In a first exemplary embodiment where the fan 384 operates at a single speed, the reduced air flow over the ice stored in the icemaker compartment 30 during the time period when the fan 384 is off reduces sublimation. The fan 384 is off between about 50% to 80% of the time, preferably being off about 80% of the time. In a second exemplary embodiment where the fan 384 operates at variable speeds, the fan 384 will operate at a low speed for about 90% of the time to reduce air flow over the stored ice thereby reducing sublimation. In one embodiment, fan speed can be controlled via a single phase 120 VAC inverter. In another embodiment, fan speed can be controlled by using a two speed motor. Energizing one coil will operate the fan 384 at a higher speed, energizing the other coil will operate the fan 384 at a lower speed.

In the first exemplary embodiment where the fan 384 operates at a single speed, the time period when the fan 384 is on is to create a substantially even temperature gradient throughout the icemaker compartment 30, so stored ice does not melt because of an elevated temperature in the ice storage bin 240 and subsequently refreeze as the temperature is reduced. The melting and refreezing of stored ice causes clumping of ice cubes, which is undesirable for dispensing and consumption. When the fan 384 operates at a single speed, the fan 384 will be on about 20% to 50% of the time, preferably being on about 20% of the time during the stored ice phase. In a second exemplary embodiment where the fan 384 can operate at variable speeds, the fan 384 will operate at a speed which is higher than the speed of the fan during sublimation reduction for about 10% of the time to create a substantially even temperature gradient throughout the icemaker compartment 30.

During the ice forming stage, water is added into the ice cavities 133 of the ice mold body 120. During this addition of water, the fan 384 of both the first and second exemplary embodiments will be turned off and will remain off for a predetermined period of time after filling of the ice cavities 133. The fan 384 will be turned off during this period to reduce evaporation from the surface of the liquid water in the ice cavities 133, which would then create frost within the icemaker compartment 30. Once this period has elapsed and the exposed surface of the ice cavities 133 has substantially solidified, the fan 384 will turn on to increase the flow of cold air, causing the ice cubes to completely solidify more quickly. The water in the ice cavities 133 will be about 0° C. when the fan 384 is turned on. In one embodiment of the first fan embodiment, the fan 384 is turned on after a short delay period of less than 2 minutes (the short delay period refers to the time difference between when the ice cavities are completely filled and when the fan is on).

In one embodiment, thermistor 218 is located adjacent to the coolant stream. When the coolant leaving the icemaker 100 is sufficiently cold, the ice cubes are considered to be fully frozen. This temperature would be around 0° C. Upon the ice cubes being fully frozen, heating elements 224 are turned on to warm the ice mold body 120 for melting the ice cubes slightly, making removal easier. During this time period when the heating elements 224 are on, the fan 384 of both the first and second exemplary embodiments will be shut off, with the fan 384 turning back on in response to the heating elements 224 turning off. The heating elements 224 will stay on for a predetermined amount of time. The fan 384 is turned off during this period so that the warm air around the ice mold body 120, which is being created by the heating elements 224, will not be blown over the ice stored in the ice storage bin 240. This is desirable so that melting of the stored ice will be kept at a minimum. In one embodiment using the single speed fan, the fan 384 is turned on after a short delay period following de-energizing of the heating elements 224. At this point, the heating elements 224 are no longer creating heat, formed ice cubes have been removed from the ice cavities 133 and the coolant pump 302 pumps cold coolant into the icemaker compartment 30.

Figure 7:
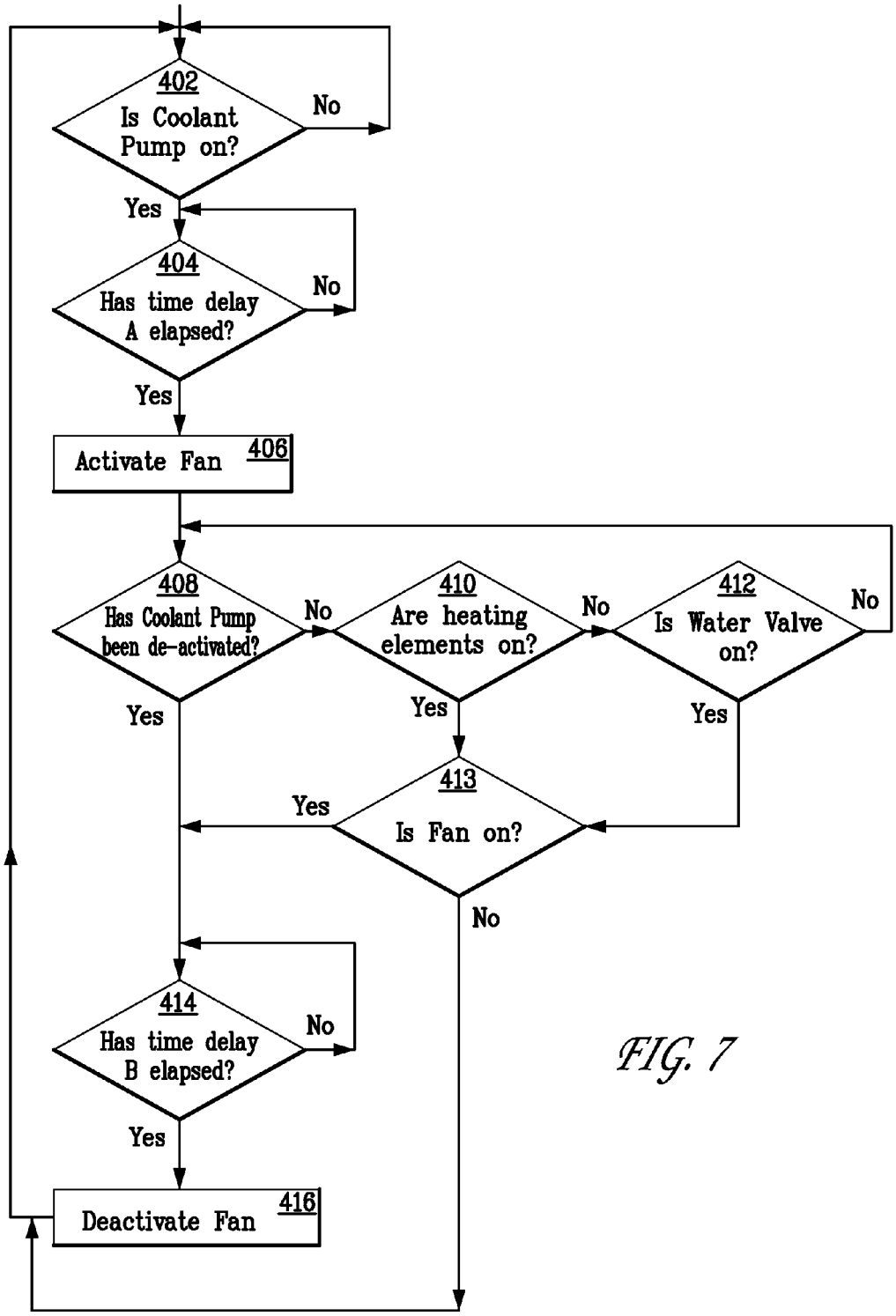
FIG. 7 is a flow diagram of an exemplary fan control method.

FIG. 7 is a flow diagram showing an exemplary fan control method starting at block 402, for a fan with a single speed of operation. This method of fan control is inputted into controller 305, as seen in FIG. 6, for example, by programming into memory of an application specific integrated circuit (ASIC) or other programmable memory device. The fan-on and fan-off time periods can be as small as zero seconds.

Referring back to FIG. 7, at block 402 controller 305 determines if coolant pump 302 is on. If coolant pump 302 is on, the controller 305 will determine if fan on time delay A has elapsed. If fan on time delay period A has elapsed, fan 384 is activated at block 406. Time delay A is the amount of time between controller 305 determining that coolant pump 302 is on and controller 305 activating fan 384.

At block 408 controller 305 determines if coolant pump 302 has been deactivated. If coolant pump 302 has been deactivated, controller 305 will determine if fan off time delay B has elapsed at block 414. Time delay B is the amount of time between controller 305 determining that coolant pump 302 has been deactivated and controller 305 deactivating fan 384. If fan off time delay B has elapsed, fan 384 will be deactivated at block 416. After fan 384 has been deactivated at block 416, controller 305 will again determine if coolant pump 302 is activated at block 402.

At block 408, if coolant pump 302 has not been deactivated, controller 305 determines if heating elements 224 have been activated at block 410. If heating elements 224 are activated, controller 305 will determine if fan 384 is off or on at block 413. If fan 384 is off at block 413, controller 305 will then again ask if coolant pump 302 is on at block 402. If fan 384 is on at block 413, controller 305 will determine if fan off time delay B has elapsed at block 414. If fan off time delay B has elapsed, fan 384 will be deactivated at block 416. At block 414, if fan off time delay B has not elapsed, controller 305 will keep fan 384 activated until the B time delay is reached. In one embodiment, B is zero seconds so that fan 384 will be deactivated at the same time that heating elements 224 are activated.

If heating elements 224 are not activated at block 410, controller 305 determines if water valve 102 is on or open at block 412. If at block 412 water valve 102 is off, controller 305 will then again ask if coolant pump 302 has been deactivated at block 408.

If at block 412 water valve 102 is on, controller 305 will determine if fan 384 is off or on at block 413. If fan 384 is off at block 413, controller 305 will then again ask if coolant pump 302 is on at block 402. If fan 384 is on at block 413, controller 305 will determine if fan off time delay B has elapsed at block 414. If fan off time delay B has elapsed, fan 384 is deactivated at block 416. At block 414, if fan off time delay B has not elapsed, controller 305 will keep fan 384 activated until the time delay B is reached. In one embodiment, B is zero seconds so that fan 384 will be deactivated at the same time that water valve 102 is opened.

During the stored ice phase, controller 305 will pass through the flow chart from 402 to 404 to 406 to 408 to 414 to 416 and back to 402.

The fundamental novel features of the invention as applied to various specific embodiments thereof have been shown, described and pointed out, it will also be understood that various omissions, substitutions and changes in the form and details of the devices illustrated and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method of circulating air within an icemaker compartment of a refrigerator, the icemaker compartment comprising a fan, a heater, and an icemaker having an ice mold body defining a plurality of ice cavities, the refrigerator comprising a coolant pump for controlling delivery of coolant to the icemaker compartment and a water valve for controlling water flow to the icemaker, the method comprising the steps of:

(a) activating the icemaker by activating the coolant pump;

(b) filling the ice cavities with water; and (c) activating the fan after a predetermined time after the ice cavities are filled with water.

2. The method of claim 1, wherein the predetermined time after the ice cavities are filled with water is set to the time required for water in the ice cavities to reach a temperature of about 0° C.

3. The method of claim 1, further comprising the steps of activating the heater for ice harvesting and deactivating the fan in response to the heater being activated.

4. The method of claim 3, further comprising the step of reactivating the fan in response to the heater being deactivated.

5. A method of circulating air within an icemaker compartment of a refrigerator, the icemaker compartment comprising a fan, a heater, and an icemaker having an ice mold body defining a plurality of ice cavities, the refrigerator comprising a water valve for controlling water flow to the icemaker and a coolant pump for controlling the delivery of coolant to the icemaker compartment, the method comprising the steps of:

(d) activating the coolant pump;

(e) activating the fan in response to activation of the coolant pump;

(f) deactivating the coolant pump; and (g) deactivating the fan in response to deactivation of the coolant pump.

6. The method of claim 5, wherein the fan is activated after a predetermined time period after the coolant pump is activated.

7. The method of claim 5, wherein the fan is deactivated after a predetermined time period after deactivation of the coolant pump.

8. The method of claim 5, further comprising the steps of activating the heater for ice harvesting and deactivating the fan in response to the heater being activated.

9. The method of claim 8, further comprising the step of reactivating the fan in response to the heater being deactivated.

10. The method of claim 9, further comprising the step of reactivating the fan after a predetermined time period after deactivation of the heater.

11. The method of claim 5, further comprising the step of deactivating the fan in response to the water valve being open.

12. The method of claim 11, further comprising the step of reactivating the fan in response to the water valve being closed.

13. The method of claim 11, further comprising the step of reactivating the fan after a predetermined time period after the water valve is closed.

14. The method of claim 13, wherein the predetermined time period is set to the time required for water in the ice cavities to reach a temperature of about 0° C.

15. The method of claim 5, wherein the coolant pump is activated when the icemaker compartment reaches a first temperature, and deactivated when the icemaker compartment reaches a second temperature, the second temperature being lower than the first temperature.

16. A refrigerator comprising:

a food storage compartment;

an access door operable to selectively close the food storage compartment;

an icemaker compartment on the access door;

an icemaker disposed in the icemaker compartment, the icemaker comprising an ice mold body defining a plurality of ice cavities;

an ice storage bin disposed in the icemaker compartment;

a fan for distributing cold air within the icemaker compartment;

at least one heating element attached to the ice mold body;

a coolant pump; and a controller for regulating the fan and the coolant pump, wherein the controller activates the coolant pump, activates the fan after a predetermined time period after activation of the coolant pump, deactivates the coolant pump, and deactivates the fan after a predetermined time period after deactivation of the coolant pump.

17. The apparatus of claim 16, wherein the fan is operable at variable speeds.

18. The apparatus of claim 17, wherein the fan has at least one higher speed of operation and at least one low speed of operation.

19. The apparatus of claim 16, wherein the controller deactivates the fan in response to the at least one heating element being activated and reactivates the fan in response to the at least one heating element being deactivated.

20. The apparatus of claim 19, wherein the controller reactivates the fan after a predetermined time period after the at least one heating element is deactivated.

21. The apparatus of claim 16, further comprising a water valve for controlling water flow to the icemaker, wherein the controller deactivates the fan in response to the water valve being on and reactivates the fan in response to the water valve being off.

22. The apparatus of claim 21, wherein the controller reactivates the fan after a predetermined time period after the water valve has been turned off.

23. A method of circulating air within an icemaker compartment of a refrigerator, the icemaker compartment comprising a fan, an icemaker and an ice storage bin, the refrigerator comprising a coolant pump for controlling the delivery of coolant to the icemaker compartment, the method comprising the steps of:

(a) deactivating the icemaker by deactivating the coolant pump;

(b) activating the fan after the icemaker is deactivated; and (c) deactivating the fan after a predetermined time period after activating the fan.

24. The method of claim 23, further comprising repeating steps (b) through (c) one or more times.

25. The method of claim 23, further comprising the steps of activating the icemaker by activating the coolant pump, and deactivating the fan in response to a signal indicating a reduction of ice in the ice storage bin.

26. The method of claim 24, wherein the fan is activated between about 20% and about 50% of the time while the icemaker is deactivated.

27. The method of claim 26, wherein the fan is activated for about 20% of the time while the icemaker is deactivated.

28. The method of claim 24, wherein the fan is operable at variable speeds.

29. The method of claim 28, wherein the fan operates at a lower speed for about 90% of the time while the icemaker is deactivated.

* * * * *